US007258068B2

(12) United States Patent
Worthington

(10) Patent No.: US 7,258,068 B2
(45) Date of Patent: Aug. 21, 2007

(54) SAFETY AND ARMING APPARATUS AND METHOD FOR A MUNITION

(75) Inventor: Marc Worthington, New Richmond, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 10/610,159

(22) Filed: Jun. 30, 2003

(65) Prior Publication Data

US 2005/0081732 A1 Apr. 21, 2005

(51) Int. Cl.
*F42C 15/188* (2006.01)

(52) U.S. Cl. ..... 102/256; 102/226; 102/229; 102/251; 102/254

(58) Field of Classification Search ..... 102/226, 102/229, 235, 242, 243, 244, 251, 254, 256
See application file for complete search history.

(56) References Cited

U.S. PATENT DOCUMENTS

| | | | | | |
|---|---|---|---|---|---|
| 1,652,635 | A | | 12/1927 | Pantoflicek | |
| 2,537,855 | A | * | 1/1951 | Porter | 102/242 |
| 2,595,757 | A | | 5/1952 | Brandt | |
| 2,863,393 | A | | 12/1958 | Sheeley | |
| 2,870,712 | A | * | 1/1959 | Brown et al. | 102/210 |
| 3,547,034 | A | * | 12/1970 | Eneman et al. | 102/232 |
| 3,603,259 | A | * | 9/1971 | Webb | 102/235 |
| 3,782,290 | A | * | 1/1974 | Reams | 102/226 |
| 3,967,556 | A | | 7/1976 | Post et al. | |
| 4,172,421 | A | * | 10/1979 | Regalbuto | 102/318 |
| 4,284,862 | A | | 8/1981 | Overman et al. | |
| 4,380,197 | A | * | 4/1983 | Eaton | 102/228 |
| 4,389,937 | A | * | 6/1983 | Golay et al. | 102/249 |
| 4,643,096 | A | * | 2/1987 | Durrell et al. | 102/250 |
| 4,741,270 | A | * | 5/1988 | Golay | 102/271 |
| 4,815,381 | A | | 3/1989 | Bullard | |
| 5,275,107 | A | * | 1/1994 | Weber et al. | 102/251 |
| 5,693,906 | A | | 12/1997 | Van Sloun | |
| 5,821,447 | A | * | 10/1998 | Reams et al. | 102/223 |
| 6,167,809 | B1 | | 1/2001 | Robinson et al. | |
| 6,237,495 | B1 | * | 5/2001 | Hok et al. | 102/245 |
| 6,481,354 | B1 | | 11/2002 | Heck et al. | |

FOREIGN PATENT DOCUMENTS

| | | | |
|---|---|---|---|
| DE | 3533753 | * | 4/1987 |

* cited by examiner

*Primary Examiner*—David Parsley
(74) *Attorney, Agent, or Firm*—Harness, Dickey & Pierce, PLC

(57) ABSTRACT

A safety and arming mechanism for a munition having a housing with a first detonator and an explosive mounted within the housing and in alignment with one another. A shaft is mounted within the housing. A first component is rotatingly fixed to the shaft and is moveable between a first and a second position. A second component is mounted on the shaft between the first detonator and the explosive. The second component is releasably fixed to the housing and is moveable between a safe and an armed position when it is released from the housing. The second component has a bore formed therethrough. The bore is aligned with the first detonator and the explosive when the first component is in the second position and the second component is in the armed position.

9 Claims, 8 Drawing Sheets

FIG 1
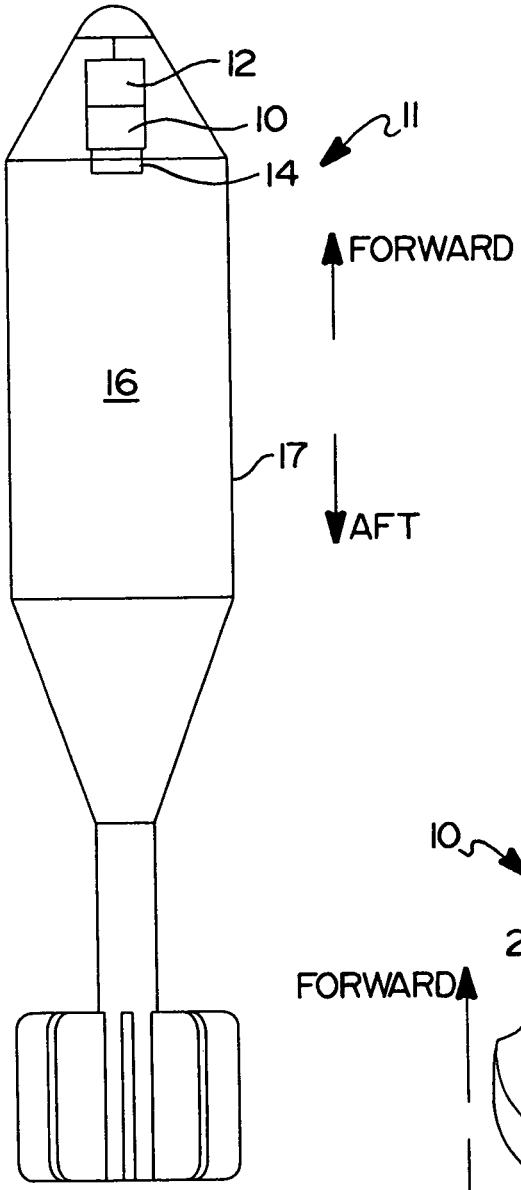
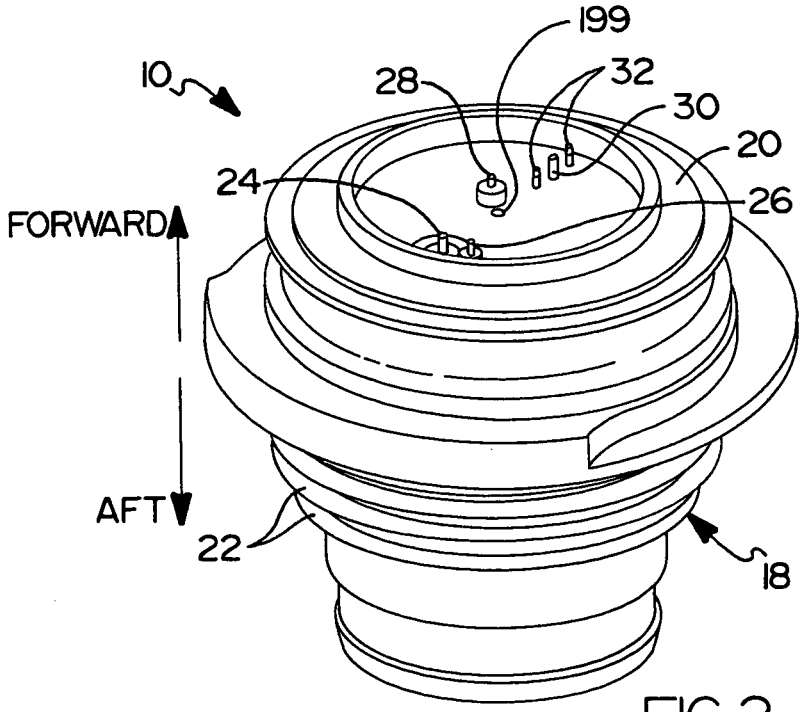
FIG 2

FIG 11
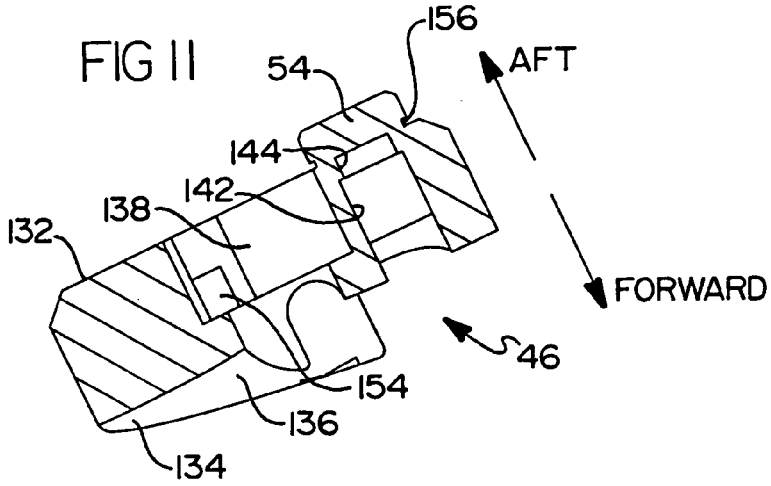
FIG 12
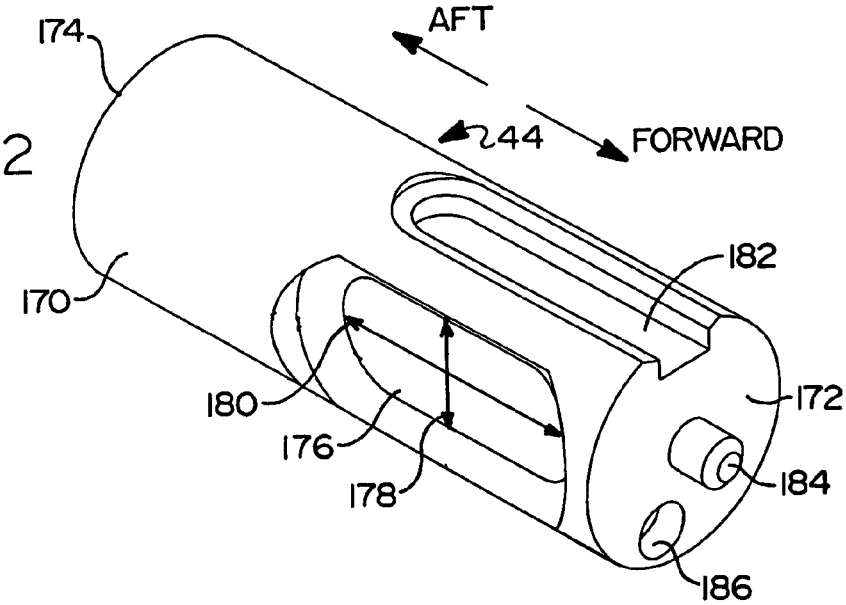
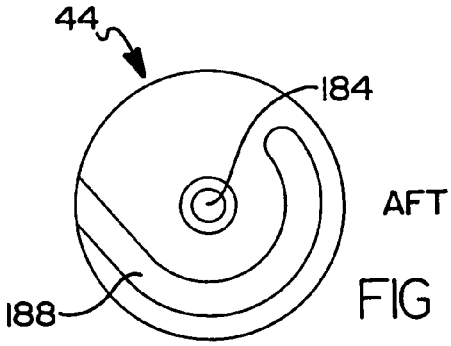
FIG 13

FIG 15
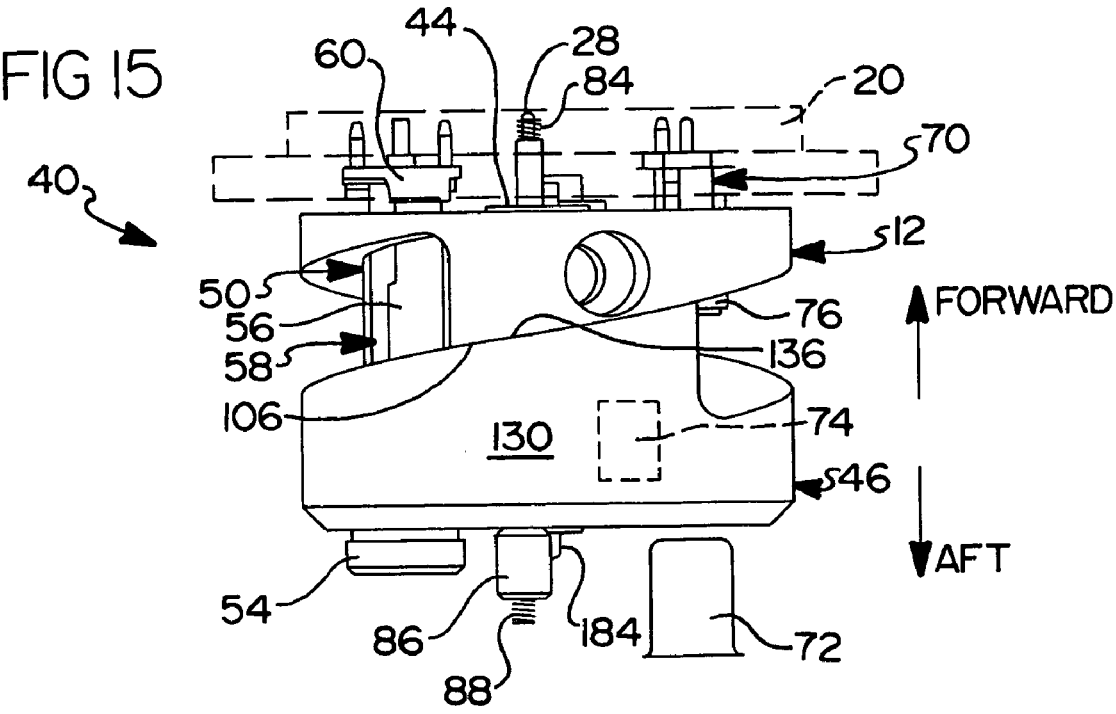
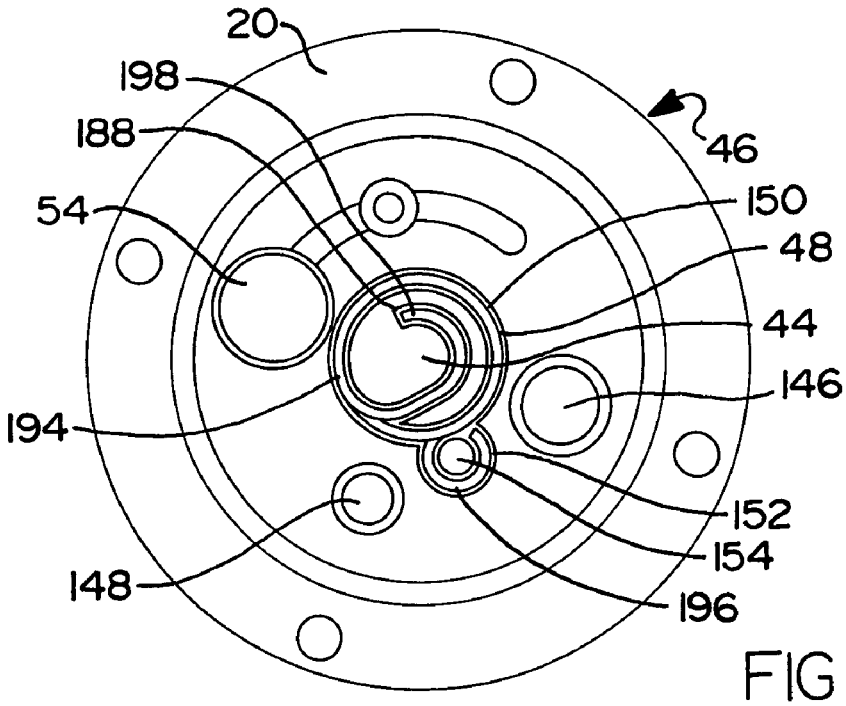
FIG 16

FIG 18
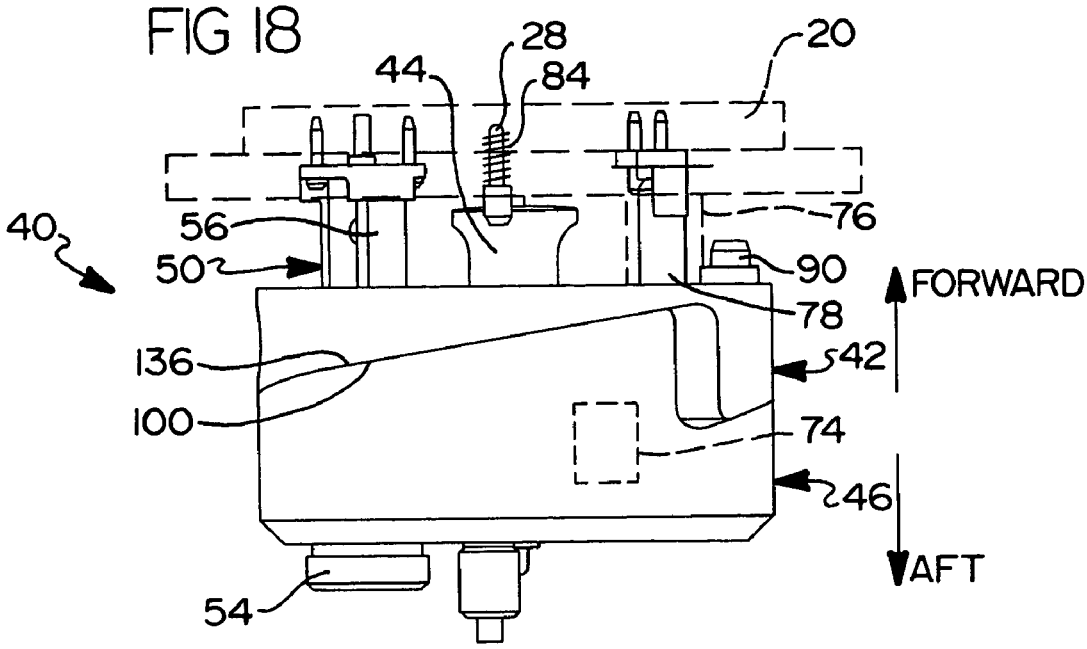
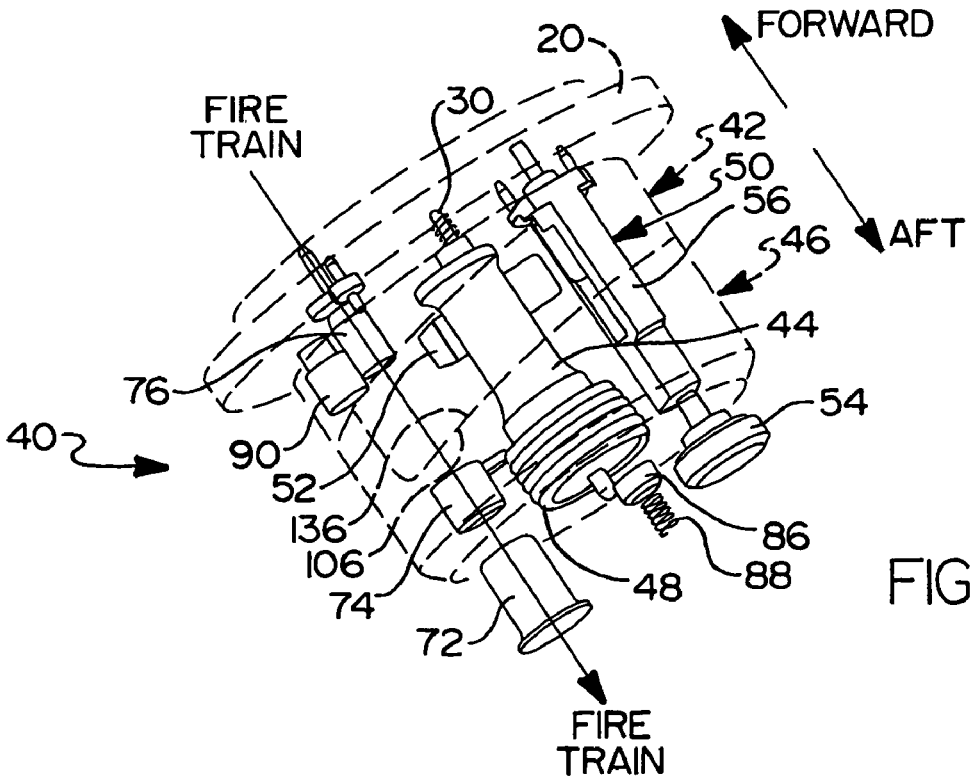
FIG 19

SAFETY AND ARMING APPARATUS AND METHOD FOR A MUNITION

FIELD OF THE INVENTION

The present invention relates to a safety and arming mechanism for munitions, and more particularly to a mechanical safety and arming mechanism for a mortar round.

BACKGROUND OF THE INVENTION

The premature detonation of such explosive devices as flares, bombs, missiles, or mortars during handling, shipping, or in storage creates a highly dangerous condition. Various safety and arming devices have been proposed in the prior art for preventing accidental arming and premature detonation of munitions. A safety and arming device is now a required element of a munition to ensure that the munition is not armed and detonated until the desired time. The safety and arming device is part of a munition's fuze and prevents arming of the fuze until certain conditions are met. Many safety and arming devices require two conditions or occurrences for operation and initiation of the fuze. The first condition utilized is typically setback acceleration which is associated with the launching of the munition. Setback acceleration of the munition is a convenient condition to measure. The second condition can be based on a number of different parameters such as barrel escape velocity, timing, counting turns or rotations of the munition, etc.

One early safety and arming device is the percussion fuze. A percussion fuze is normally held inoperative by a safety device which is released by setback forces developed upon launching of a projectile. Such a fuze is shown in U.S. Pat. No. 1,652,635.

Another proposed safety and arming device includes a fuze wherein movement of a setback slide mechanism pivots a lever. The movement of the lever activates a timing mechanism. The timing mechanism releases a detonator carrier which is moved into an armed position. One such device is shown in U.S. Pat. No. 2,863,393.

Still another type of fuze device has been proposed in which a slide mechanism responds to setback forces developed during sustained acceleration of a projectile to arm the fuze. A typical device of this type is disclosed in U.S. Pat. No. 2,595,757, and more recently in U.S. Pat. Nos. 4,284,862 and 4,815,381.

Other examples of prior devices that use the setback acceleration condition to arm a fuze include zig-zag gravity weights, gravity weight driven escapements, successive falling leaves, and various combinations of these devices.

However, many of these devices suffer from several drawbacks. For example, many require a great number of parts, many require close tolerances between these parts, and many have limited accuracy and reliability. More specifically, in some prior safety and arming devices, a latch must move in order to catch a setback lock before rebounding. This creates a "race" wherein the latch has to catch the setback lock before rebounding in order for the device to work. Devices utilizing these designs are typically of lower reliability than desired and can lead to a greater risk of unintended arming. Further, these prior arming devices, because of the great number of independent parts required for their operation, typically require more space than is sometimes desired or available.

While all these various safety and arming mechanisms are suitable for their intended purposes, there is room in the art for an improved safety and arming mechanism that is easy to assemble, less costly to manufacture, compact in size and, most importantly, extremely reliable.

Accordingly, it is an object of the present invention to provide the art with an improved safety and arming mechanism with reliable interaction of components while simultaneously reducing the number of component parts required for operation of the mechanism.

SUMMARY OF THE INVENTION

A safety and arming mechanism for a munition is disclosed having a housing with a first detonator and a second detonator mounted within the housing, and with the detonators in alignment with one another. A shaft is also mounted within the housing. A first component is rotatably fixed to the shaft and is moveable between a first position and a second position within the housing. A second component is also mounted on the shaft between the first detonator and the second detonator. The second component is releasably fixed to the housing and is moveable from a "safe" position to an "armed" position when it is released from the housing. The second component has a bore formed therethrough.

A biasing member is fixed to the shaft and also fixed to the second component. An actuator extends from the first component through the second component. The actuator is capable of freeing the second component for rotation with respect to the housing. The bore is aligned with the first detonator and the second detonator when the first component is in the second position and the second component is in the "armed" position, thus providing an uninterrupted firing chain.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a side sectional view of an exemplary warhead having a safety and arming mechanism (S&A mechanism) constructed according to the principles of the present invention;

FIG. 2 is a perspective view of the S&A mechanism;

FIG. 11 is a sectional view of the rotor taken in the direction of arrows 11-11 as indicated in FIG. 10;

FIG. 12 is a forward perspective view of a winder shaft in the S&A mechanism;

FIG. 13 is a plan view of the aft end of the winder shaft looking forward;

FIG. 15 is a side view of the S&A mechanism assembly in a safe condition;

FIG. 16 is an end view of the aft end of the S&A mechanism assembly;

FIG. 18 is a side view of the S&A mechanism assembly in a wound condition; and FIG. 19 is a perspective view of the S&A mechanism in an armed condition.

DETAILED DESCRIPTION OF THE PREFERRED EMBODIMENTS

Figure 3:
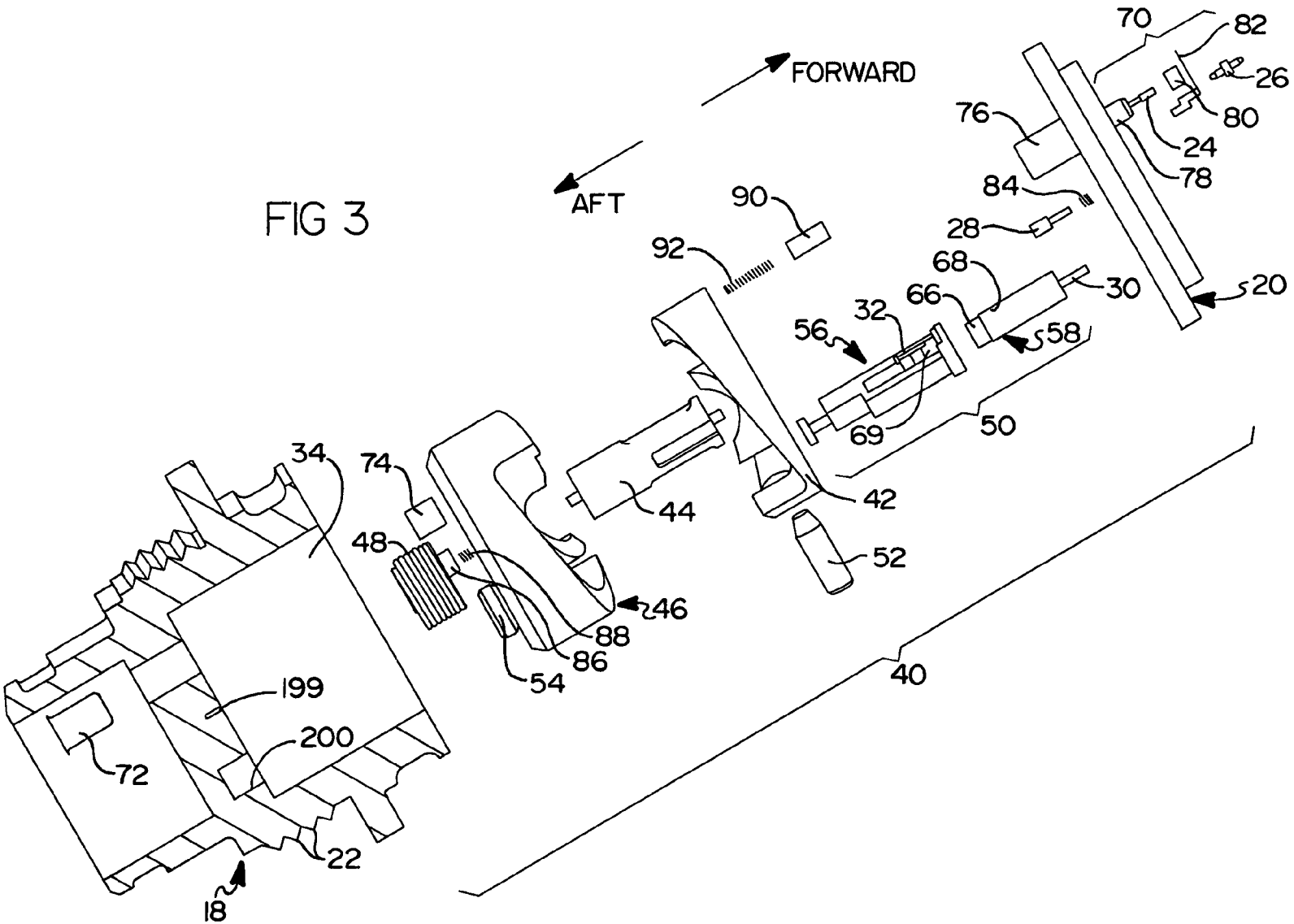
FIG. 3 is an exploded perspective view of the interior arrangement of the S&A mechanism.

The following description of the preferred embodiment(s) is merely exemplary in nature and is in no way intended to limit the invention, its application, or uses.

Referring to FIG. 1, there is illustrated an exemplary munition in the form of a mortar warhead, indicated generally by reference numeral 11, having a safety and arming mechanism (hereinafter S&A mechanism) 10 constructed in accordance with a preferred embodiment of the present invention. While the S&A mechanism 10 is illustrated for use in a mortar, it is to be understood that it may be employed in any form of munition which is fired as a projectile. The S&A mechanism 10 is located within the mortar 11 and is in communication with an electronics module 12 mounted forwardly of the S&A mechanism 10. The S&A mechanism 10 is also in alignment with a booster 14 mounted aft of the S&A mechanism 10. The booster 14 is an explosive that is in communication with a main explosive 16. The main explosive 16 is contained within a housing 17. The electronics module 12 determines when to attempt to fire the sequence of detonators and explosives located within the S&A mechanism 10, as will be described in greater detail below. The detonators and explosives within the S&A mechanism 10 function to fire the booster 14 which then fires the main explosive 16.

Referring to FIG. 2, the S&A mechanism 10 will now be described in greater detail. The S&A mechanism 10 generally includes a housing 18 and a cap 20 fixed thereon. The housing 18 includes a threaded portion 22 to aid in the installation of the S&A mechanism 10 onto the mortar housing 17. The electronics module 12 sits forward of the S&A mechanism 10 and interfaces with the cap 20 when installed within the mortar 11. Specifically, the cap 20 includes openings for receiving a M100 "hot" pin 24 of a M100 detonator, a M100 ground pin 26 of the M100 detonator, a forward detent 28, an actuator "hot" pin 30, and actuator ground pins 32. The connections 24, 26, 30, 32 and the forward detent 28 all lead into the S&A mechanism 10, as will be described below, and are in communication with the electronics module 12.

Referring now to FIG. 3, the housing 18 generally includes a cavity 34 for housing an S&A mechanism assembly, generally indicated by reference numeral 40. The S&A mechanism assembly 40 includes a setback weight 42, a winder shaft 44, a rotor 46, a rotor spring 48, and an actuator assembly 50. The setback weight 42 is rotationally fixed to the winder shaft 44 by a pin 52. The winder shaft 44 extends through the rotor 46 and is fixed at its end to an end of the rotor spring 48. The rotor spring 48 is in turn fixed at its other end to the rotor 46. The rotor 46 is fixed to the housing 18 by a boss 54 formed on the rotor 46. The actuator assembly 50 extends from the cap 20 through the setback weight 42 and into the rotor 46. The rotor 46 is preferably formed as a single piece component from a plastic material, for example polytetraflouroethylene. This enables the boss 54 to be sheared off during firing, as will be explained further in the following paragraphs.

Figure 4:
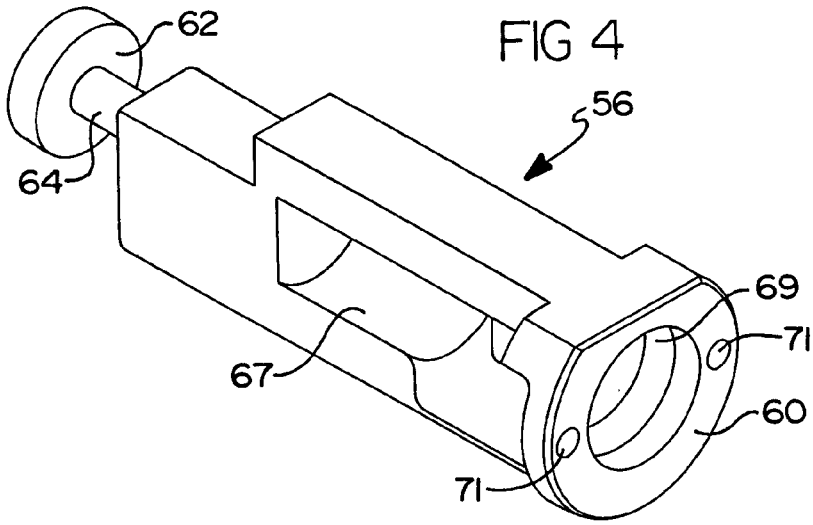
FIG. 4 is a perspective view of an actuator lock in the S&A mechanism.

The actuator assembly 50 includes an actuator lock 56 which houses a piston actuator 58. As best seen in FIG. 4, the actuator lock 56 includes an enlarged header 60 at one end and a piston head 62 at the other. The piston head 62 is fixed to a neck 64 having a cross sectional area less than that of the piston head 62. With further reference to FIGS. 3 and 4, the piston actuator 58 contains a piston 66 and a pyrotechnic explosive 68 housed within a cut-out 67 of the actuator lock 56 (FIG. 4) to extend the piston 66. The pyrotechnic explosive 68 is in communication with the actuator hot pin 30. The actuator ground pins 32 contacts a ground contact 69 also located within the actuator lock 56 through holes 71 formed in the actuator lock 56. As noted above, the actuator hot pin 30 and ground pin 32 are in communication with the electronics module 12. An electric signal from the electronics module 12 through the actuator hot pin 30 ignites the pyrotechnic explosive 68 and forces the actuator lock 56 in the aft direction, as will be described in greater detail below.

The S&A mechanism assembly 40 includes two detonators that, when aligned, permit firing of the main explosives 16 by the electronics module 12. The first detonator assembly, or M100 assembly, indicated by reference numeral 70, is located within the cap 20. A explosive, or lead 72, is mounted within the housing 18 and is aligned with the M100 assembly 70. A second detonator, for example an M55 detonator, indicated by reference numeral 74, is located within the rotor 46 and rotates with the rotor 46 to align between the M100 assembly 70 and the lead 72. When all three components 70, 72, and 74 are longitudinally aligned, firing the M100 assembly 70 fires the M55 74, which in turn fires the lead 72. The lead 72 in turn fires the booster 14 (FIG. 1) which ignites the main explosives 16.

The M100 assembly 70 is located within a tubular extension 76 formed on the aft side of the cap 20. The tubular extension 76 extends down through the setback weight 42 and terminates with an open end at the rotor 46. The M100 assembly includes an M100 electric detonator 78. The M100 "hot" pin 24 extends through a cap insulator 80 into the M100 electric detonator 78. The M100 ground pin 26 extends into an M100 ground contact 82 mounted on the cap insulator 80. An electric signal from the electronics module 12 through the M100 "hot" pin 24 ignites the M100 detonator 78.

Further components of the S&A mechanism assembly 40, as seen in FIG. 3, include a forward detent spring 84 which biases the forward detent 28 in the aft direction, an aft detent 86 mounted within the rotor 46 and engagable with the housing 18, an aft detent spring 88 which biases the aft detent 86 in the aft direction, a setback lock 90 mounted within the setback weight 42 and engagable with the cap 20, and a setback lock spring 92 which biases the setback lock 90 in the forward direction. The interaction of these components will be described in greater detail below.

Figure 5:
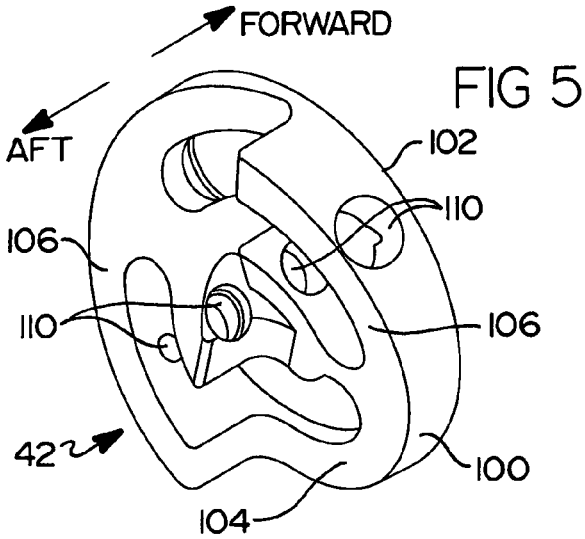
FIG. 5 is a perspective view of a setback weight in the S&A mechanism.
Figure 6:
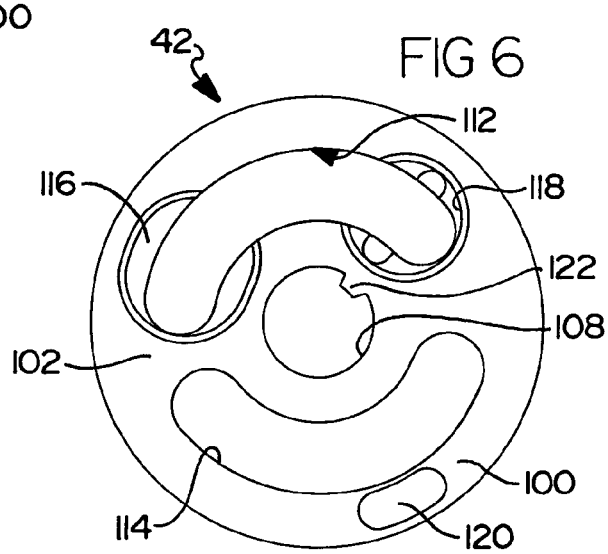
FIG. 6 is a plan view of the forward end of the setback weight looking in the aft direction.
Figure 7:
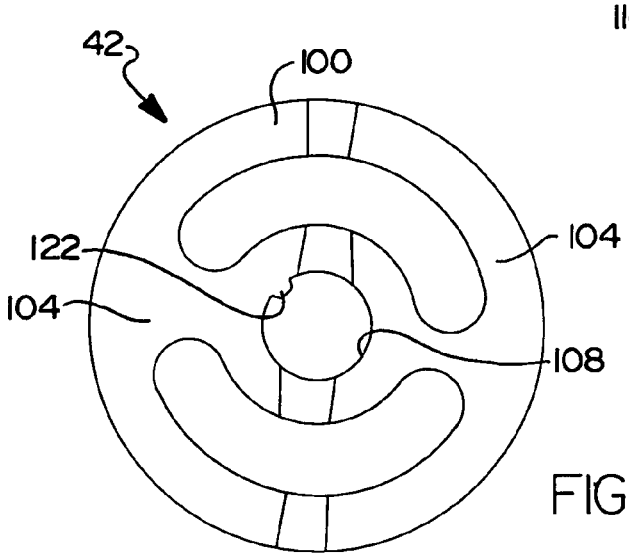
FIG. 7 is a plan view of the aft end of the setback weight looking in the forward direction.

With reference to FIGS. 5-7, the setback weight 42 will now be described. The setback weight 42 includes a generally cylindrical body 100 with a flat forward end 102 and a ramped aft end 104. The ramped aft end 104 is defined by two ramping surfaces 106 along the circumference of the setback weight 42. A winder shaft bore 108 extends through the center of the body 100 from the flat forward end 102 to the ramped aft end 104. The winder shaft bore 108 is sized to receive the winder shaft 44 (FIG. 3) therethrough. A plurality of aligned side holes 110 extend through the body 100 between the forward and aft ends 102, 104 and are sized to receive the pin 52 (FIG. 3). With the winder shaft 44 extending through the winder shaft bore 108 and the pin 52 extending through two of the plurality of side holes 110, the setback weight 42 is rotationally fixed to the winder shaft 44.

The setback weight 42 further includes an actuator bore 112 and a cap bore 114 extending through the body 100 from the forward end 102 to the aft end 104. The actuator bore 112 and the cap bore 114 each extend in an arc along the circumference of the setback weight 42. The cap bore 114 is sized to receive the tubular extension 76 of the cap 20 (FIG. 3). The actuator bore 112 is sized to receive the actuator assembly 50 (FIG. 3). The actuator bore 112 further includes a first enlarged circumferential opening 116 and a second enlarged circumferential opening 118. The enlarged circumferential openings 116, 118 are located at opposite ends of the actuator bore 112 and are sized to receive the enlarged header 60 of the actuator lock 56 (FIG. 4), as will be described in greater detail below.

The setback weight 42 also includes a setback lock bore 120 formed on the forward end 102, as best seen in FIG. 6. The setback lock bore 120 extends into the body 100 and is sized to receive the setback lock spring 92 (FIG. 3) followed by the setback lock 90 (FIG. 3). Finally, a tab 122 is formed within the winder shaft bore 108. The tab 122 is sized to fit within a groove formed on the winder shaft 44, as will be described in greater detail below.

With reference to FIGS. 8-11, the rotor 46 will now be described in further detail. The rotor 46 includes a generally cylindrical body 130 with a flat aft end 132 and a ramped forward end 134. The ramped forward end 134 is defined by two ramping surfaces 136 along the circumference of the rotor 46. A winder shaft bore 138 extends through the center of the body 130 from the flat aft end 132 to the ramped forward end 134. The winder shaft bore 138 is sized to receive the winder shaft 44 (FIG. 3) therethrough.

An actuator bore 140 extends through the body 130 from the aft end 132 to the forward end 134. The actuator bore 140 extends in an arc along the circumference of the rotor 46 and is surrounded by a cutout 142 that extends from the forward end 134 into the body 130. The cutout 142 is sized to receive the piston head 62 of the actuator lock 56 (FIG. 4). The actuator bore 140 has an enlarged end portion 144 aligned with the boss 54. The purpose of this alignment will become clear when the operation of the S&A mechanism assembly 40 is described below. The enlarged end portion 144 is sized to receive the piston head 62 of the actuator lock 56 and the actuator bore 140 is sized to receive the neck 64 of the actuator lock 56 (FIG. 4).

Figure 8:
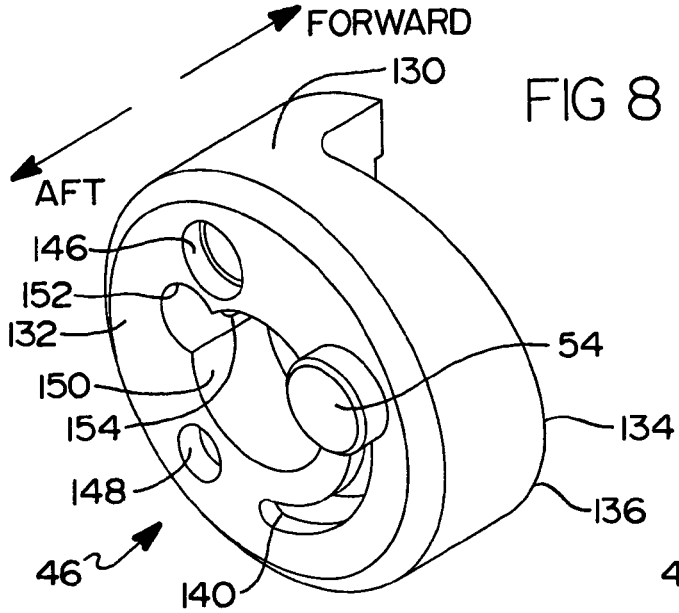
FIG. 8 is a perspective view of a rotor in the S&A mechanism.
Figure 9:
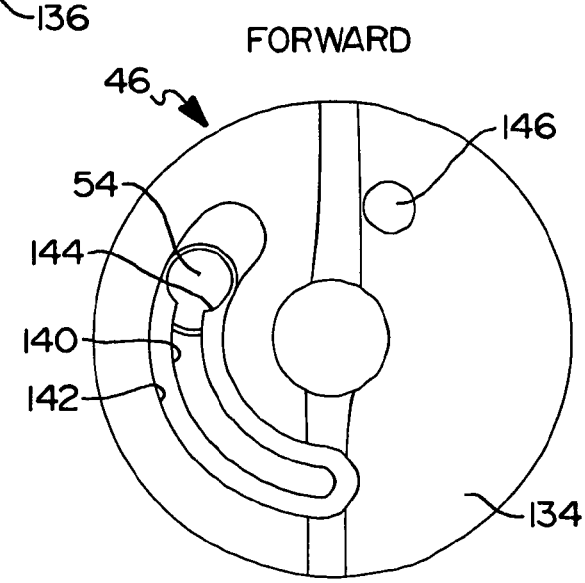
FIG. 9 is a plan view of the forward end of the rotor looking in the aft direction.
Figure 10:
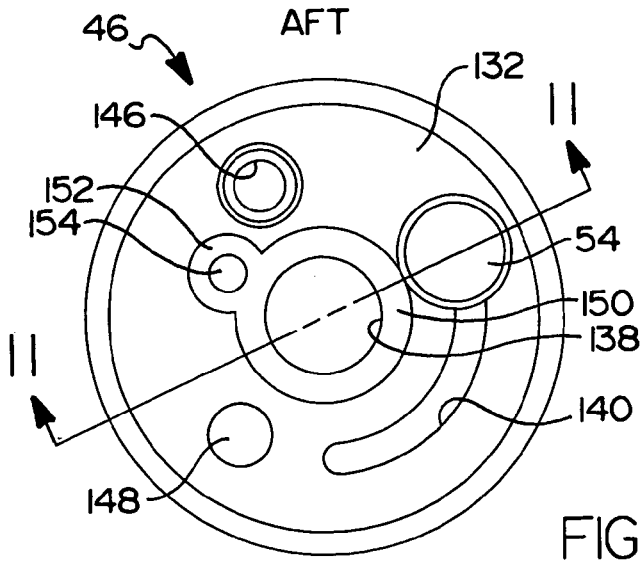
FIG. 10 is a plan view of the aft end of the rotor looking in the forward direction.

As best seen in FIGS. 8 and 10, the rotor 46 further includes an M55 bore 146 and an aft detent bore 148 formed on the aft end 132. The M55 bore 146 extends through the body 130 from the aft end 132 to the forward end 134 and is sized to receive the M55 detonator 74 (FIG. 3). The aft detent bore 148 extends into the body 130 and is sized to receive the aft detent spring 88 followed by the aft detent 86 (FIG. 3). A spring cutout 150 extends around the circumference of the winder shaft bore 138 and further extends to a circular cutout portion 152 tangential to the spring cutout 150. The circular cutout portion 152 at its center defines a post 154. The spring cutout 150 and circular cutout portion 152 are sized to receive portions of the rotor spring 48 (FIG. 3), as will be described in greater detail below.

As best seen in FIG. 11, the boss 54 is formed on the rotor 46 and includes a neck 156 having a reduced cross-sectional area. This reduced cross sectional area of the neck 156 acts as a stress concentration zone, and a force applied to the boss 54 will lead to a fracture within the neck 156 rather than the rotor 46 or the boss 54.

Referring to FIGS. 12 and 13, the winder shaft 44 has a long cylindrical body 170 with a forward end 172 and an aft end 174. A pin cutout 176 extends through the body 170 from one side of the winder shaft 44 to the other. The pin cutout 176 defines an opening having a width 178 parallel to the forward and aft ends 172, 174 and a length 180 perpendicular to the forward and aft ends 172, 174. The width 178 is sized to receive the pin 52 (FIG. 3). The length 180 is sufficient to allow the pin 52 to translate freely along the length of the winder shaft 44. The length 180 of the pin cutout 176 is defined by the degree of translation of the setback weight 42 (FIG. 5) and pin 52 in the forward and aft directions required to sufficiently load the rotor spring 48 (FIG. 3), as will become clear from the description of the operation of the S&A mechanism assembly 40 provided below.

A groove 182 formed in the body 170 extends from the forward end 172 to the termination of the length 180 of the pin cutout 176. The groove 182 is sized to receive the tab 122 of the setback weight 42 (FIG. 6). The groove 182 and tab 122 act as a lock and key to properly align the winder shaft 44 when installed within the winder shaft bore 108 of the setback weight 42.

A pair of posts 184 extend from the forward and aft ends 172, 174 of the winder shaft 44, and are located along the longitudinal axis of the body 170. A forward detent receiver 186 is formed on the forward end 172 offset from the longitudinal axis of the body 170. The forward detent receiver 186 extends into the body 170 and is sized to receive the forward detent 28. A hooked cutout 188 is formed in the aft end 174 and is sized to receive a portion of the rotor spring 48 (FIG. 3), thereby fixing the rotor spring 48 to the winder shaft 44. The hooked cutout 188 extends from a side of the body 170 and at least partially hooks around the post 184.

Figure 14:
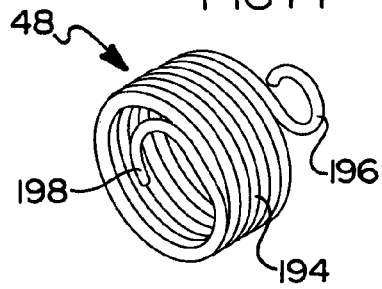
FIG. 14 is a perspective view of a rotor spring in the S&A mechanism.

With reference to FIG. 14, the rotor spring 48 is shown to include a coiled body portion 194 with a small hooked end 196 and a large hooked end 198. The rotor spring 48 is sized to fit within the various cutouts formed in the rotor 46 (FIG. 10) and the winder shaft 44 (FIG. 13). While in the particular example provided, cutouts have been illustrated to secure the rotor spring 48, various other methods of attachment may be employed, such as adhesives or holes. Likewise, while various springs have been illustrated to provide a biasing force in the various components of the S&A mechanism assembly 40, other methods of biasing the components may be employed.

The assembly and operation of the S&A mechanism 10 will now be described with continued reference to FIGS. 1-14, and with specific reference to FIGS. 15-19. Starting with FIG. 15, the S&A mechanism assembly 40 is illustrated in an unarmed or "safe" configuration. The winder shaft 44 is mounted between the housing 18 (FIG. 3) and the cap 20. The posts 184 of the winder shaft 44 fit within holes 199 formed in the housing 18 and cap 20 and allow the winder shaft 44 to rotate with respect to the housing 18.

The setback weight 42 and the rotor 46 are mounted on the winder shaft 44. The setback weight 42 sits forward of the rotor 46. The ramping surfaces 106 of the setback weight 42 are slidingly engaged with the ramping surfaces 136 of the rotor 46. The boss 54 of the rotor 46 is fitted within a notch 200 formed in the interior cavity 34 of the housing 18 (FIG. 3). The boss 54 prevents the rotor 46 from rotating with respect to the housing 18.

The rotor spring 48 connects the winder shaft 44 and setback weight 42 to the rotor 46, as best seen in FIG. 16. The body portion 194 of the rotor spring 48 rests within the spring cutout 150 of the rotor 46 and the small hooked end 196 lies within the circular cutout portion 152 and wraps around the post 154, thereby securing the rotor spring 48 to the rotor 46. Meanwhile, the large hooked end 198 extends within the hooked cutout 188 of the winder shaft 44 and likewise secures the rotor spring 48 to the winder shaft 44.

Referring back to FIG. 15, the actuator assembly 50 extends through the actuator bore 112 (FIG. 6) inline with the enlarged circumferential opening 118 (FIG. 6) of the setback weight 42 and extends into the rotor 46. The actuator assembly 50 is aligned with the enlarged end portion 144 (FIG. 9) and the boss 54 of the rotor 46. In the safe position, the actuator assembly 50 is in its stored position such that the enlarged header 60 is raised above the enlarged circumferential opening 118 of the setback weight 42. When the electronics module 12 (FIG. 1) fires the piston actuator 58, the actuator lock 56 is thrust in the aft direction into its extended position, as will be described further below.

Figure 17:
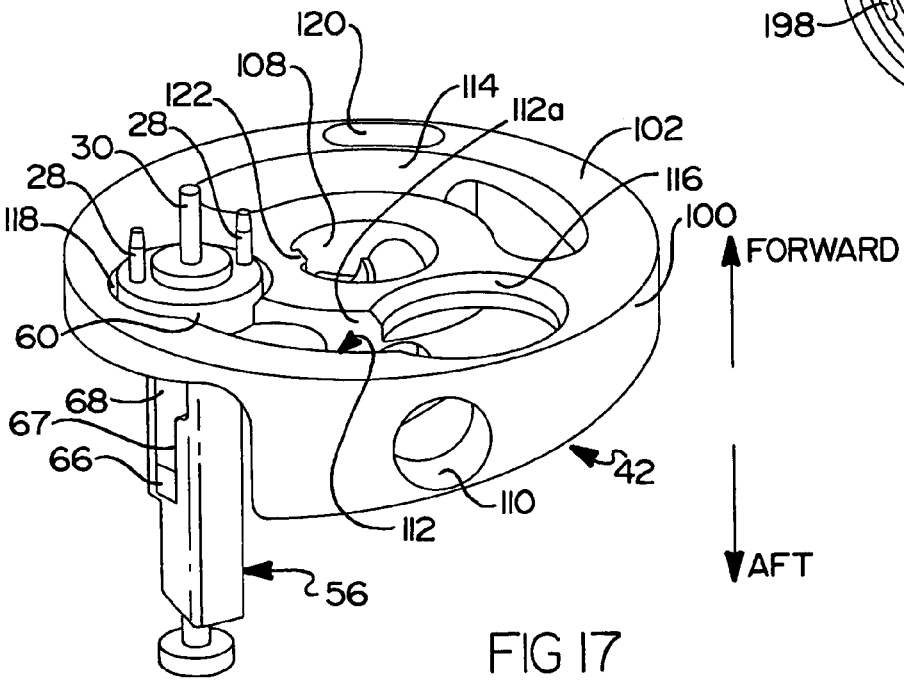
FIG. 17 is a side perspective view of the setback weight and piston actuator in a piston misfire condition.

Referring briefly to FIG. 17, if the actuator assembly 50 is fired by the electronics module 12 (FIG. 1) before the setback weight has rotated to its "wound" configuration, the enlarged header 60 of the actuator lock 56 will fit within the enlarged circumferential opening 118 of the setback weight 42. The enlarged header 60 has a diameter greater than a width of a mid-portion 112*a* of the actuator bore 112, and the actuator lock 56 will prevent rotation of the setback weight 42, thereby preventing the detonator train to align and allow for firing of the main explosive 16.

With reference again to FIG. 15, in the "safe" configuration the forward detent 28 is biased by the forward detent spring 84 against the forward end 172 (FIG. 12) of the winder shaft 44. In this position, the forward detent 28 extends up through the cap 20, as best seen in FIG. 2, and interfaces with the electronics module 12, serving as an indicator to the electronics module 12 of the position of the setback weight 42.

As noted above, the tubular extension 76 of the cap 20 extends through the cap bore 114 (FIG. 6) of the setback weight 42 and is aligned with the lead 72 mounted in the housing 18. However, the body 130 of the rotor 46 lies between the M100 assembly 70 and the lead 72 since the M55 detonator 74 is rotated out of alignment with these components 72, 76 while the S&A mechanism assembly 40 is in this "safe" configuration. An order to fire the M100 assembly 70 by the electronics module 12 would not in turn fire the M55 detonator 74, thus preventing the main explosive 16 from firing.

Referring now to FIG. 18, the S&A mechanism assembly 40 is illustrated in its "wound" configuration. When the mortar 11 is fired from a weapons system it travels in the forward direction. The acceleration of the mortar 11 creates a force on the setback weight 42, urging the setback lock 90 to disengage and the setback weight 42 to translate and rotate via the matching ramps 106, 136 in the aft direction. This in turn rotates the winder shaft 44 which in turn loads the connected rotor spring 48 (FIG. 16). As the setback weight 42 rotates, the tubular extension 76 and actuator assembly 50 stay within the cap bore 114 (FIG. 6) and actuator bore 112 (FIG. 6), respectively.

With sufficient acceleration, the setback weight 42 rotates the winder shaft 44 until the forward detent 28, biased aft by the forward detent spring 84, slips within the forward detent receiver 186 (FIG. 12). Preferably, the winder shaft 44 is rotated approximately 105 degrees before the forward detent 28 moves into position, however, various other degrees of rotation may be employed depending on such factors as the spring constant of the rotor spring 48 and the mass of the setback weight 42. At this point, as shown in FIG. 18, the setback weight 42 is locked into place in this "wound" configuration. Also, movement of the forward detent 28 aft removes it from contact with the electronics module 12. This break in electrical contact signals to the electronics module 12 that the rotor spring 48 has been loaded or "wound". The actuator assembly 50 remains in its stored position throughout the movement of the setback weight 42 and remains aligned with the boss 54.

With reference to FIG. 19, the S&A mechanism assembly 40 is illustrated in its "armed" configuration. The electronics module 12 is now free to fire the actuator assembly 50. The neck portion 64 (FIG. 4) of the actuator lock 56 is now in line with the actuator bore 140. When fired, the actuator lock 56 moves aft through the enlarged end portion 144 (FIG. 9) of the actuator bore 140 and strikes the boss 54. This forces the boss 54 to shear off from the rotor 46 at its neck 156 (FIG. 11).

The rotor 46, now free to rotate with respect to the housing 18, is urged by the loaded rotor spring 48 to rotate via the matching ramps 106, 136 in the forward direction. The rotor 46 continues to rotate until such time as the aft detent 86, urged in the aft direction by the aft detent spring 88, locks into a groove (not shown) formed in the housing 18. This locks the rotor 46 into the "armed" position wherein the M100 assembly 70, the M55 detonator 74, and the lead 72 are all aligned into a firing train. Up until the point when the S&A mechanism assembly 40 is in its "armed" configuration, the body 130 of the rotor 46 has acted as a barrier between the M100 assembly 70 and the lead 72. Finally, the electronics module 12 can order when the M100 assembly 70 is to fire, allowing the mortar 11 to detonate in proximity, point, or penetration modes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A safety and arming mechanism for a munition having a longitudinal axis of travel comprising:

a housing comprising a body and a cap;

a first detonator and an explosive mounted to said housing and in alignment with one another;

a longitudinal shaft mounted axially within said housing, centered on the longitudinal axis of travel of said munition;

a first component rotatingly fixed to said shaft and moveable around said shaft between a first position and a second position within said housing;

a second component mounted on said shaft between said first detonator and said explosive, said second component releasably fixed to said housing and moveable around said shaft between a safe and an armed position when released from said housing, said second component having a bore formed there through said first component having a helically ramped lower surface slidingly engaging with a ramped upper surface of said second component;

a biasing member fixed to said shaft and fixed to said second component; and an actuator extending from said first component through said second component, parallel to said shaft, said actuator capable of freeing said second component for rotation with respect to said housing;

wherein said bore is aligned with said first detonator and said explosive when said first component is in said second position and said second component is in said armed position; and wherein said second component is releasably fixed to said housing by a boss formed on an aft end of said second component extending aftwards, relative to the axis of travel of said munition, wherein said actuator is aligned with said boss, and said actuator travels longitudinally aftwards relative to the axis of travel of said munition to shear said boss from said second component when said actuator is actuated.

2. The safety and arming mechanism of claim 1, further comprising a spring biased forward detent mounted to said cap of said housing and capable of fixing said shaft from rotation relative to said housing when said first component is in said second position.

3. The safety and arming mechanism of claim 1, wherein said biasing member is a coil spring and one end of said spring is fixed to said shaft and the other end of said spring is fixed to said second component.

4. The safety and arming mechanism of claim 3, wherein said actuator comprises a shaft moveable longitudinally relative to the directional axis of travel of said munition, between a stored position and an extended position and having a detonator mounted therein, wherein discharging said detonator forces said actuator shaft from said stored position to said extended position thereby shearing said boss from said second component.

5. The safety and arming mechanism of claim 4, wherein said shaft includes a head engageable with said first component when in said extended position, thereby fixing said first component from moving.

6. The safety and arming mechanism of claim 1, further comprising an aft detent mounted on said second component relative to the axis of travel of said munition and capable of fixing said second component to said housing when said second component is in said armed position.

7. The safety and arming mechanism of claim 1, further comprising a second detonator parallel to the axis of said shaft mounted within said bore of said second component.

8. A method for arming a munition having a defined longitudinal axis of travel, having a first detonator aligned with a second detonator comprising:

providing a rotor, rotatably moveable around a shaft mounted axially within said housing, centered on the longitudinal axis of travel of said munition between a safe and an armed position mounted between the first detonator and the second detonator, the rotor releasably fixed from movement and having a bore formed there through;

moving a first component from a first position to a second position, said first component having a helically ramped lower surface slidingly engaging with a ramped upper surface of said rotor, said first component simultaneously winding a spring fixed at one end to said first component and fixed at another end to said rotor;

fixing said first component in said second position; and moving an actuator, positioned parallel to said longitudinal axis of travel of the munition, from a stored position to an extended position aftward parallel to the axis of travel of said munition such that said actuator frees said rotor to move relative to said first component, previously retained in position by a boss formed on an aft end of said rotor extending aftwards, relative to the axis of travel of said munition, wherein said actuator is aligned with said boss, said actuator travels longitudinally aftwards relative to the axis of travel of said munition to shear said boss from said rotor when said actuator is actuated, said spring thereby moving said rotor from a safety position to an armed position wherein said bore is aligned with the first detonator and the second detonator.

9. The method for arming a munition of claim 8, further comprising fixing said second detonator in said armed position.

* * * * *